United States Patent [19]

Soliman

[11] Patent Number: 4,846,675

[45] Date of Patent: Jul. 11, 1989

[54] ANNEALING FURNACE

[75] Inventor: Mohamed M. Soliman, Westerville, Ohio

[73] Assignee: Worthington Industries, Inc., Columbus, Ohio

[21] Appl. No.: 57,360

[22] Filed: Jun. 1, 1987

[51] Int. Cl.[4] ..... F27D 15/02; F27B 11/00

[52] U.S. Cl. ..... 432/77; 432/206; 266/256

[58] Field of Search ..... 432/23, 77, 206, 257, 432/199; 266/256, 251, 263

[56] References Cited

U.S. PATENT DOCUMENTS

| | | | |
|---|---|---|---|
| 1,938,306 | 12/1933 | Webb . | |
| 2,463,222 | 3/1949 | Vaughan | 432/206 |
| 2,485,995 | 10/1949 | Armstrong . | |
| 2,781,188 | 2/1957 | McKeown . | |
| 2,798,716 | 7/1957 | Pugh . | |
| 2,834,590 | 5/1958 | Pugh . | |
| 2,964,307 | 12/1960 | Van Dine . | |
| 3,081,074 | 3/1963 | Blackman et al. | 432/206 |
| 3,112,919 | 12/1963 | Gunow . | |
| 3,179,394 | 4/1965 | Sims et al. . | |
| 3,199,853 | 8/1965 | Olsen . | |
| 3,411,763 | 11/1968 | Blackman et al. | 432/206 |
| 3,603,570 | 9/1971 | Galeone . | |
| 3,832,129 | 8/1974 | Derbyshire et al. . | |
| 3,850,417 | 11/1974 | Elorza . | |
| 4,151,400 | 4/1979 | Smith et al. . | |
| 4,596,526 | 6/1986 | Soliman . | |

*Primary Examiner*—Henry C. Yuen

*Attorney, Agent, or Firm*—Fay, Sharpe, Beall, Fagan, Minnich & McKee

[57] ABSTRACT

An apparatus for treating a work item includes a cover member and a base member on which the cover member is supported. A work space is defined between the base member and the cover member for receiving at least one associated work item which is positioned therein. A first sealing member is positioned between the base member and the cover member for sealing the work space against the environment. A hood member is provided for enclosing the cover member and defining a heating and cooling space therebetween. A cooling apparatus is also provided for cooling the first seal member. The cooling apparatus comprises a first cooling fluid channel which is secured to the base member, a second cooling fluid channel which is secured to the cover member and a cooling fluid trough which is secured adjacent to the second cooling fluid channel.

36 Claims, 4 Drawing Sheets

FIG. 4
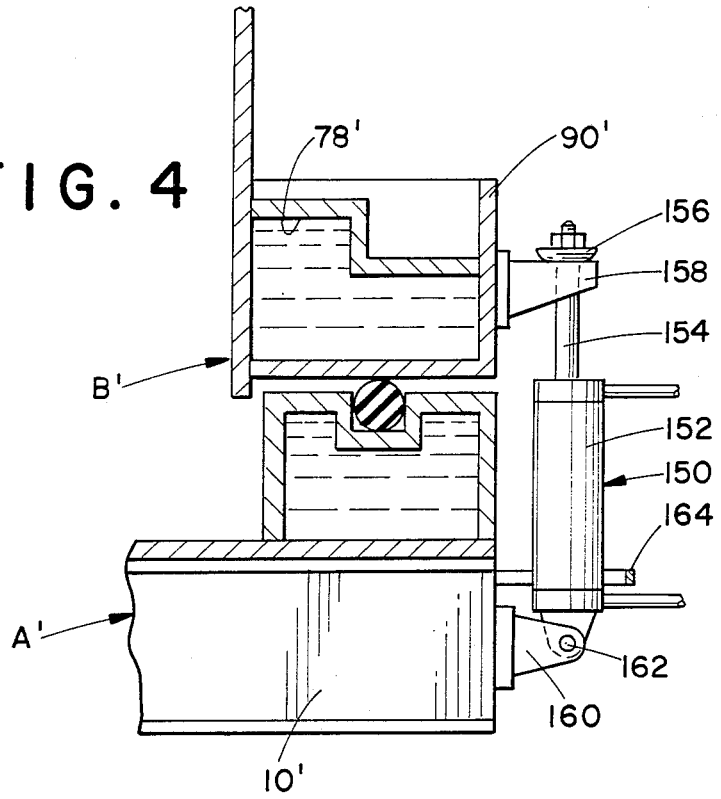
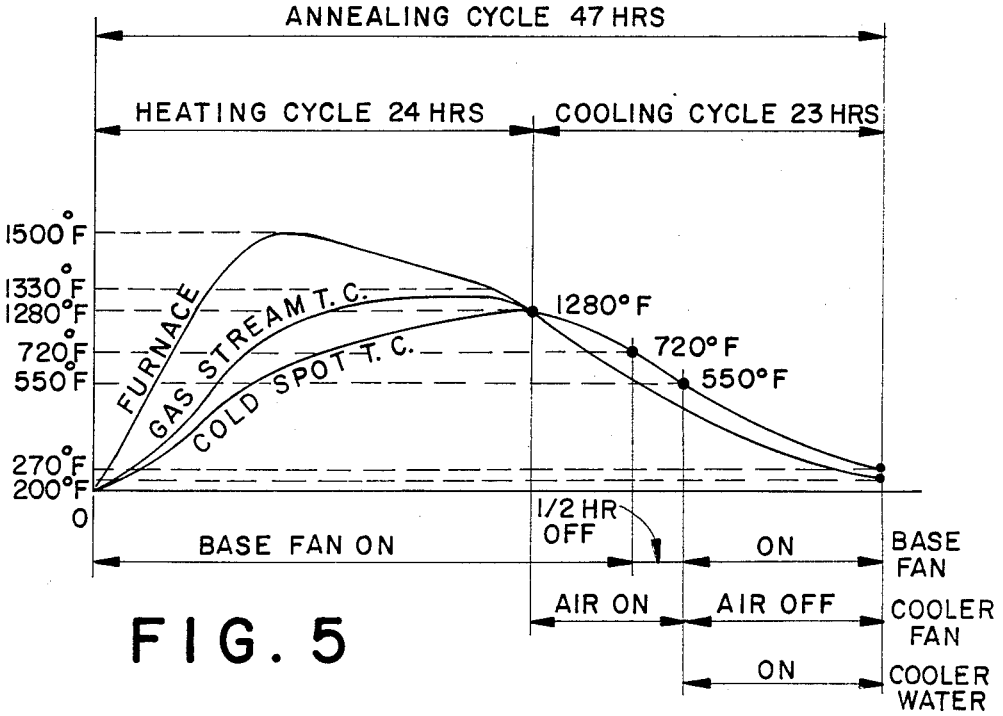
FIG. 5

ANNEALING FURNACE

BACKGROUND OF THE INVENTION

This invention generally pertains to apparatus and methods for heat treatment. More particularly, the invention relates to batch coil annealing furnaces and various improvements therein.

Although the invention will be described with particular reference to a specific annealing furnace design for treating batches of metallic coils, it will be appreciated by those skilled in the art that the invention has broader applications and may generally be applied to any type of work item treatment device wherein at least one work item is placed within an enclosure for heating and/or cooling purposes.

Metals are annealed to reduce their hardness, and improve machinability, facilitate cold working, produce a desired micro structure or to obtain desired mechanical, physical, or other properties. Annealing of metal strips and the like is generally accomplished by winding the strips into coils, each having an axial passage bounded by the inner diameter of the winding. Several coils can be stacked on top of one another, with a convector plate between each pair of coils, and enclosed in a sealed inner cover. The inner cover defines a work space and is, itself enclosed in a hood member. During the heating phase of the annealing cycle, the hood member is a heating hood. During the cooling phase of the annealing cycle, the hood member can be a cooling hood.

During the heating phase, heat is transferred from a heating space, defined between the heating hood and the inner cover, to the inner cover and, in turn, to the coils. The primary mode of heat transfer from the cover to the coils is by radiation. Additionally, a gas atmosphere is circulated within the inner cover by a base fan to achieve a more rapid and uniform heat transfer by convection. For proper annealing, a conventional gas atmosphere of a suitable gas such as a nitrogen/hydrogen mixture, or pure hydrogen or the like needs to be supplied.

In order to maintain this type of gas atmosphere against the intrusion of the ambient atmosphere, some type of seal means is desirable between the inner cover and the base on which the inner cover rests.

One of the difficulties with providing a seal in this environment is caused by the high temperatures to which the annealing furnace is exposed. Such high temperatures have a detrimental effect on the seal. Consequently, a cooling means needs to be provided for this seal. Generally, there is also a seal means between the heating hood or furnace and the base and this seal means also needs to be cooled.

In addition, when a cooling hood replaces the heating hood, water is sometimes used for cooling purposes. This water needs to be collected and conveyed away from the annealing furnace by a suitable means.

Another difficulty with conventional annealing furnaces is that the base of the annealing furnace is exposed to fairly high temperatures and this has a detrimental effect on a conventional castable insulation mix base, which leads to a shortening of the lifetime of the base. Such conventional bases soak up moisture and release it during heating causing a decarburization of the metal being annealed. Also, conventional bases are prone to erosion due to the thermal cycles they undergo and the moisture gains and losses they experience as a consequence. This erosion can take the form of pitting or scoring of the base which causes dust to appear in the work space under the inner cover. Such dust is deleterious to the metal being annealed. Also, when conventional bases are made, they need to be dried out very slowly, usually for at least 7 days which means the annealing furnacer is out of commission for that period of time.

Accordingly, it has been considered desirable to develop a new and improved annealing furnace which would meet the above-stated needs and overcome the foregoing difficulties and others while providing better and more advantageous overall results.

BRIEF SUMMARY OF THE INVENTION

In accordance with the present invention, a new and improved apparatus for heat treating a work item is provided.

More particularly in accordance with the invention, the apparatus comprises a cover means and a base means on which the cover means is supported. A work space is defined between the base means and the cover means for receiving at least one associated work item which is positioned therein. A first sealing member is positioned between the base means and the cover means for sealing the work space against the environment. A hood means is provided for enclosing the cover means and defining a heating and cooling space therebetween. A cooling means is provided for cooling the first seal member with the cooling means comprising a first cooling fluid channel secured to the base means, a second cooling fluid channel secured to the cover means and a cooling fluid trough secured adjacent the second cooling fluid channel.

In accordance with another aspect of the invention, at least one of the first and second channels is suitably configured so as to house the first sealing member.

According to another aspect of the invention, the coolant fluid trough includes an inlet means and an outlet means. Preferably, the outlet means is a drain opening.

According to a further aspect of the invention, the apparatus further comprises a fastener means for fastening the cover means to the base means to draw the pair of channels towards each other. In one embodiment, the fastener means comprises a threaded stem and a nut. In another embodiment, the fastener means comprises a piston and cylinder assembly.

In accordance with a still further aspect of the invention, the base means comprises a support member and a base member positioned on the support member. The base member includes an insulation means for insulating the support member from heat and a metallic outer shell for enclosing the insulation means. The outer shell is designed for heat expansion and is provided with integral curved upper peripheral edges to prevent weld cracks as the shell undergoes heating.

In accordance with a yet further aspect of the invention, the base means further comprises a diffuser member supported atop the outer shell. The diffuser member has a planar main portion and a peripheral skirt which is outwardly curved so that it lies at an angle of approximately 120° to the plane of the diffuser member main portion.

According to a further aspect of the invention, a method for annealing is provided.

More particularly in accordance with the method, an annealing furnace is provided with the furnace having a base, a base fan secured thereto, and a cover member supported on the base together with a heating hood enclosing the cover member. At least one work item is positioned on the base such that it is enclosed by the cover member. The at least one work item is heated by the heating hood for a length of time. The base fan is operated during this step of heating. Subsequently, the step of heating is ended, and the heating hood is removed. The cover member is then enclosed by a cooling hood including a cooling fan. The at least one work item is then cooled with the cooling hood. The cooling hood fan is operated during the step of cooling while the base fan continues to be operated. Subsequently, the base fan is shut off for a period of time while the cooling hood fan continues to be operated. Thereafter, the base fan is restarted and the at least one work item continues to be cooled.

According to still a further aspect of the invention, the step of continuing to cool comprises the subsidiary steps of shutting off the cooling hood fan and spraying a cooling fluid onto the cover member through a cooling fluid spray head provided on the cooling hood.

According to a yet further aspect of the invention, the step of heating is carried out until a temperature of approximately 1280° F. (693° C.) is reached inside the cover member. Preferably, the step of continuing to cool is carried out until a temperature of approximately 200° to 300° F. (93° to 149° C.) is reached inside the cover member. Also preferably, the step of shutting off the base fan is begun when the temperature inside the cover member is approximately 720° F. (382° C.) and is ended when the temperature inside the cover member is approximately 550° F. (288° C.).

One advantage of the present invention is the provision of an annealing furnace which has an improved cooling means that enables the seal means of the furnace to be adequately cooled and also enables the water sprayed on the cover member by the cooling hood to be conducted away.

Another advantage of the present invention is the provision of an annealing furnace base means. The base means advantageously includes a metallic outer shell to avoid the dust and decarburization problems caused by conventional bases made of a castable insulation mix. The metallic outer shell is designed for heat expansion and is provided with integral curved upper peripheral edges.

Still another advantage of the present invention is the provision of a diffuser member on an annealing furnace base means. The diffuser member is designed to speed up the heat transfer that takes place during the annealing process.

Yet another advantage of the present invention is the provision of a new and improved apparatus for annealing which produces a cleaner and brighter annealed metal.

A further advantage of the present invention is the provision of a new and improved method of annealing which is considerably faster than conventional annealing processes.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof and wherein:

FIG. 4 is a greatly enlarged side elevational view of a portion of the annealing furnace of FIG. 1 utilizing a different fastening means to fasten an adjacent pair of cooling fluid channels to each other; and, FIG. 5 is a chart showing the various parameters which are met during the use of the annealing furnace of FIGS. 1 and 3 in a complete annealing cycle.

DETAILED DESCRIPTION OF THE PREFERRED AND ALTERNATE EMBODIMENTS

Figure 1:
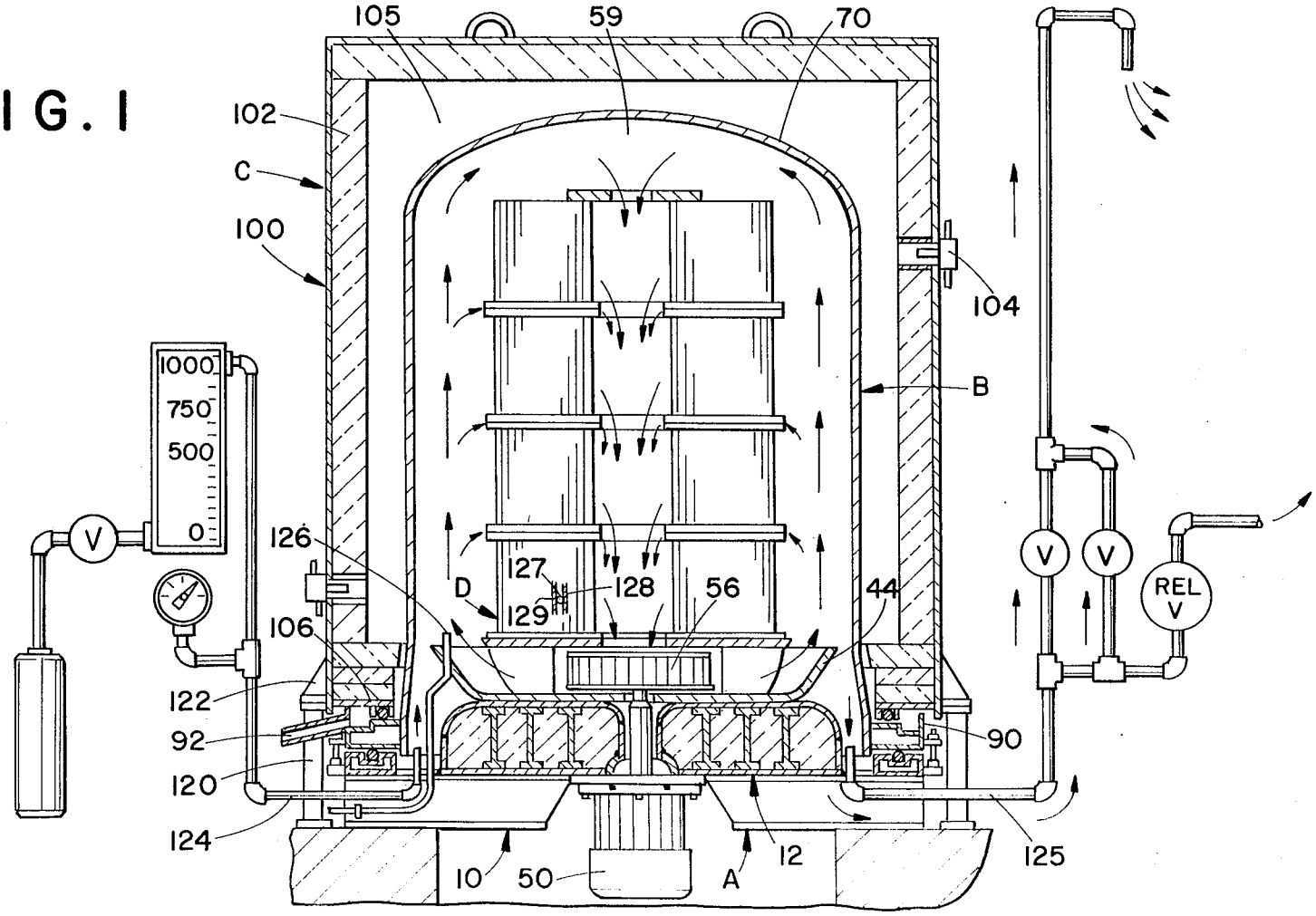
FIG. 1 is a side elevational view in partial cross-section of a preferred embodiment of the subject new annealing furnace with a heating hood in place.

Referring now to the drawings wherein the showings are for purposes of illustrating the preferred and alternate embodiments on the invention only and not for purposes of limiting same, FIG. 1 shows the subject new annealing furnace which includes a base means A, a cover means B, and a furnace hood or heating hood C. While the preferred embodiment of the invention is primarily designed for and will hereinafter be described in connection with a batch coil annealing furnace, it will be appreciated that the overall inventive concept involved could be adapted for use in other heat treating environments as well.

Figure 2:
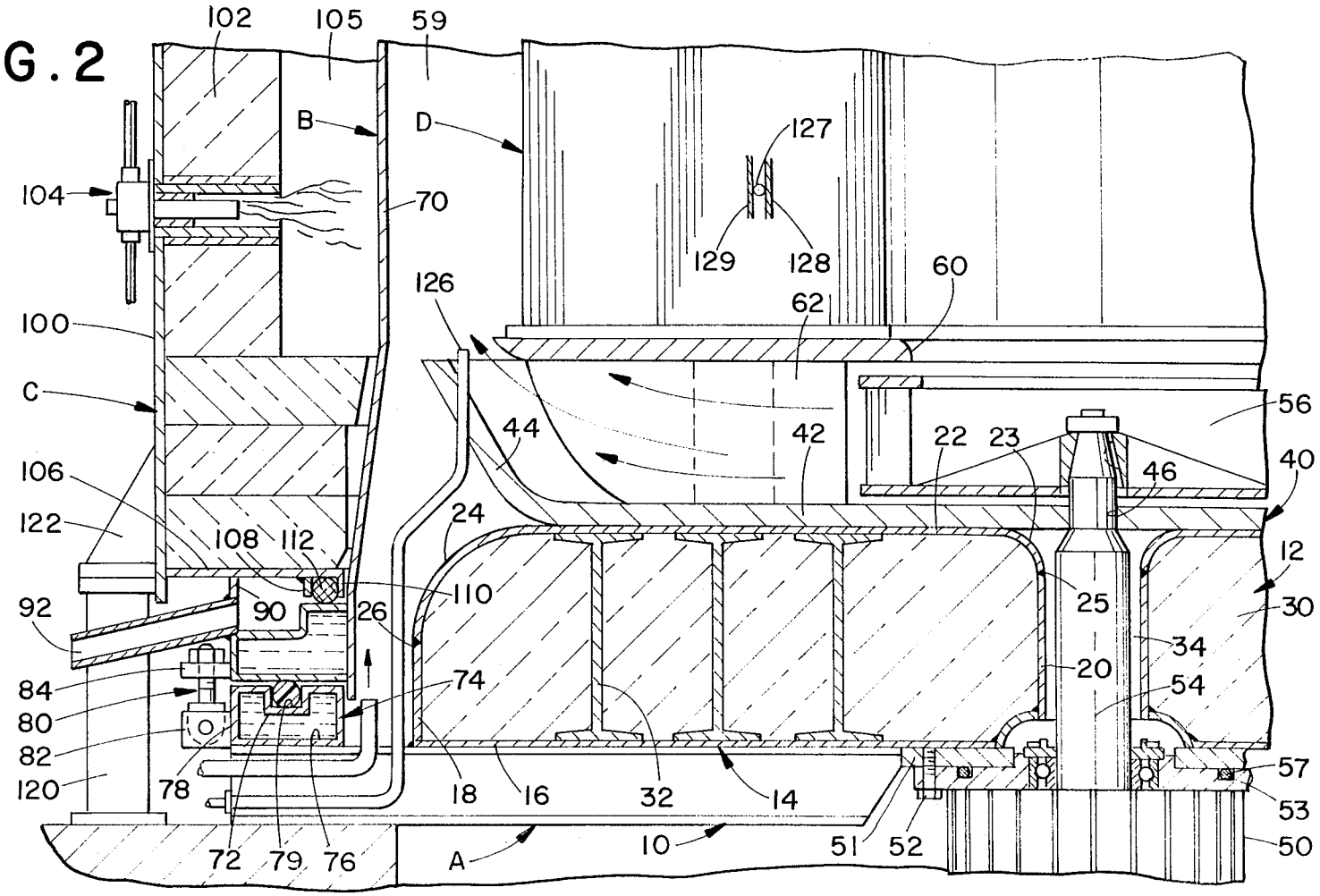
FIG. 2 is an enlarged side elevational view in partial cross-section of a lower left hand portion of the annealing furnace of FIG. 1.

More specifically, and with reference now also to FIG. 2, the annealing furnace includes a base means A which comprises a plurality of support members 10 upon which is positioned a base member 12. The base member, which can be of a desired conventional shape such as circular, square, or rectangular, includes a metallic cover or shell 14 which is comprised of a bottom wall 16, an outer side wall 18, an inner side wall 20, and a top wall 22. The top wall has curved peripheral inner and outer edges 23,24 which meet the inner and outer side walls in a substantially vertical plane. The top wall is secured to the inner and outer side walls along respective inner and outer weld joints 25,26. It has been found that providing the shell with curved upper peripheral edges 23,24 prevents weld cracks in the shell despite the high temperatures to which the shell is exposed in the annealing furnace. It has been found that shells with upper edges that meet at a substantially 90° angle with a weld joint thereat would crack the weld joint because of the high temperature thermal cycles that the base means A is exposed to.

It has also been found that a metal encased base member substantially reduces decarburization and dust problems in the annealing furnace. The base member of the present invention improves steel quality by providing a cleaner, brighter steel at the end of the annealing process. Also, a metal encased base member has been found to be advantageous because it saves approximately a week of start up time which was necessary with conventional castable insulation mix bases to dry out the base.

Provided within the base 12 is an insulation means 30 which may be a typical conventional insulation material such as wool fiber refractory insulation. Also positioned within the base 12 are one or more support means 32 which can, as illustrated, be in the form of conventional I-beams. Extending transversely through the base is a centrally located bore 34 which is defined by the annular inner side wall 20 of the base.

Positioned atop the base is a diffuser member 40 which is comprised of a planar main portion 42 and a peripheral skirt portion 44. Preferably, the peripheral skirt portion is curved at an approximately 120° angle to the diffuser main portion. This is advantageous in that it guides the flow of gas from the diffuser discharge opening to the inner cover side walls thereby speeding up the heating and cooling cycles of the annealing furnace. It has been determined that the use of such a diffuser decreases the annealing furnace heating cycle by approximately seven hours from the heating cycle of a conventional annealing furnace. Additionally, it has been found that the cooling cycle length is cut by three hours from that of a conventional annealing furnace by the use of the instant diffuser with curved peripheral edges.

Extending transversely through the diffuser main portion 42 is a central bore 46. A fan motor 50 is secured to a base flange 51, that is welded to the support members 10, by fasteners 52 which extend through a motor flange 53. A fan shaft 54 extends through the base central bore 34 and the diffuser central bore 46. Positioned within the diffuser member is a fan 56 that is fastened to the fan shaft 54 and has a plurality of fan blades. A conventional seal 57 can be provided between the flange 51 and the motor flange 53 to seal the annealing furnace against the suction caused by the fan 56 at the shaft 54 thereof.

As in most conventional annealing furnaces, the fan blades circulate a controlled gaseous atmosphere within a work space 59 defined between the inner cover B and the base A to allow a transfer of heat to and from the work item D.

With continuing reference to FIG. 2, the work item D is supported on a support member 60 which sits atop a plurality of pillars 62 that rest on the diffuser member main portion 42.

The cover member B includes a body portion 70 which is conventionally substantially cylindrical in shape and is closed at one end (FIG. 1). Positioned between the base A and cover the member B is a seal means 72. This may be in the form of an O-ring or the like. Preferably, the seal means is made of a conventional resilient rubber-like material. Because of the high temperatures to which an annealing furnace is exposed, a cooling means 74 needs to be provided for the seal means 72. In the present invention, the cooling means comprises a first cooling fluid channel 76 and a second cooling fluid channel 78. The first channel 76 is substantially annular and is secured to the support members 10 radially outwardly of the base member 12 in spaced relation thereto. The channel 76 can be enclosed as shown and provided with a groove 79 so as to house the first seal means 72. The second channel 78 is similarly substantially annular and is secured to a radially outward side of the cover member body 70 near the base thereof so as to overlie the first channel 76.

A fastening means 80 is also provided to draw the first and second channels 76,78 toward each other thereby ensuring that a tight seal exists between the base A and the cover member B. The fastening means cooperates with a pair of flanges provided on the channels 76,78. More specifically, a first flange 82 is provided on the first channel 76 so as to extend radially outwardly therefrom as is evident from FIG. 2. A second flange 84 extends radially outwardly from the second channel 78 and overlies the first flange such that the fastening means can extend therethrough. The fastening means can be a conventional bolt which is pivotably secured at one end to the first flange 82 and is threaded at its other end in order to receive a suitable conventional nut. When the nut is unthreaded from the bolt, the bolt can be pivoted away from the second flange 84 since a suitable slot (not visible in FIG. 2) is provided in the second flange for this purpose.

With reference now again to FIG. 1, a water trough 90 is provided adjacent the second channel 78. The water trough is defined between an upstanding flange located at the radially outer circumference of the second channel 78 and the body portion 70. The trough 90 follows the peripheral outline of the cover body 70 and the second channel 78. An outer means in the form of an outlet funnel 92 is provided for the trough 90.

A hood body 100 of the heating hood C is adapted to enclose the cover body 70. An insulation means 102 of conventional form is provided inside the hood body as is illustrated in FIG. 2. A plurality of burners 104 extend through the hood body so as to deliver heat into a heating space 105 defined between the heating hood C and the cover member B. Although only two such burners are illustrated in the cross-sectional view of FIG. 1, in the embodiment illustrated eight burners are employed with the burners spiraling around the periphery of the hood body 100. With reference again briefly to FIG. 2, the hood body 100 includes a base wall 106 which has adjacent a radially inner end thereof, a pair of spaced downwardly extending flanges 108,110. A furnace seal 112, which can be a fiber blanket insulation type of seal, is provided between the flanges, which serve as a housing for the seal.

A plurality of support pillars 120 which are spaced radially around the base A cooperate with outwardly extending flanges 122 of the hood body 100 and serve to support the hood. Thus, the full weight of the hood is not supported on the fluid channels 76,78.

Extending into the working space 59 defined between the cover member B and the base A is a gas inlet conduit or pipe 124 which allows a working gas into the working space. It can be seen that a gas outlet conduit or pipe 125 extends into the working space in spaced relation to the inlet conduit 124.

Also extending into the working space is a first thermocouple 126 which can extend through the diffuser skirt 44 as shown in order to lie in the gas stream. Also provided is a second thermocouple 127 which is manually positioned within one of the work items D before the annealing process is begun. The work item can be a metal coil with the second thermocouple being positioned between two adjacent sections 128,129 of the coil. The first thermocouple 126 is referred to as the gas stream thermocouple and the second thermocouple 127 can be termed the cold spot thermocouple since the temperature at its location will be somewhat less than that at the gas stream termocouple during the heating phase of the annealing cycle.

Figure 3:
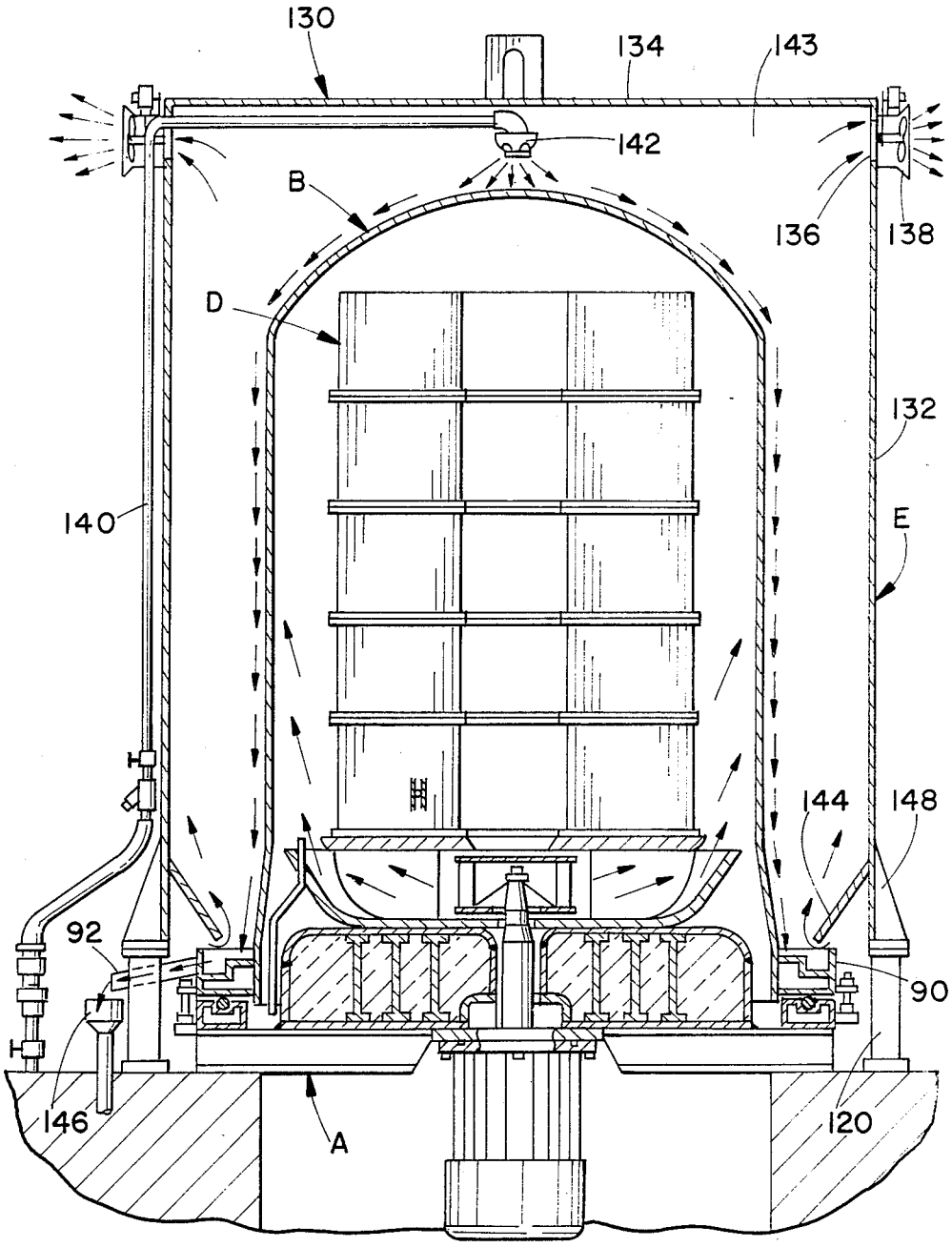
FIG. 3 is a side elevational view in partial cross-section of the annealing furnace of FIG. 1 with a cooling hood in place.

With reference now also to FIG. 3, once the heat treatment of the work item is finished, the heating hood C is removed and a cooling hood E is placed over the cover member B. The cooling hood E includes a body member 130 having side walls 132 and a top wall 134. Adjacent the top wall 134 is a side wall aperture 136. Positioned over this aperture is a conventional fan 138 which is adapted to cause an atmospheric circulation through the cooling hood thereby cooling off the cover member B and hence the work items D. Preferably, at least two such apertures and fans are provided in the cooling hood as is illustrated.

A cooling fluid conduit 140 runs up one side of the body member 130, extends through the body member wall adjacent the top wall 134 thereof and terminates in an inlet means such as a shower head 142 positioned in a cooling space 143 defined between the cooling hood E and the cover member B. During a certain portion of the cooling cycle, a cooling fluid, such as water, is sprayed through the shower head onto the cover member B to cool the cover member and hence the work item D. The cooling water inlet temperature can be approximately 85° F. and the outlet temperature, at a flow rate of approximately 45 gallons per minute, has been found to be approximately 97° F. Water cooling of the inner cover B by conduction cools off the work items D by convection of gas in the work space 59.

An inwardly extending annular flange 144 is positioned adjacent a lower edge of the body member side walls 132 to direct inwardly any spray of cooling fluid which may be splashed outwardly while the cooling fluid is running down the cover member B. The inwardly extending annular flange 144 directs such cooling fluid into the trough 90 so that it can eventually flow out through the outlet means or funnel 92 thereof and into a conventional drain member 146.

Outwardly extending flanges 148 of the cooling hood cooperate with the pillars 120 to enable the cooling hood to be supported.

Not illustrated for the sake of simplicity in FIG. 3 are the inlet and outlet gas conduits shown in FIG. 1. It should, however, be understood that gas is also circulated in the work space 59 during the cooling phase of the annealing cycle.

Atmospheric air is drawn by the fans 138 into the cooling space 143 defined between the cooling hood E and the cover member B through a gap between the bottom of the flange 144 and the top of the trough 90. Thus, atmospheric air is circulated through the cooling space 143 in the flow pattern indicated in FIG. 3.

With reference now to FIG. 4, the invention is there shown as utilizing a different type of fastening means 150 for urging a pair of cooling fluid channels toward each other. For ease of illustration and appreciation of this embodiment, like components are identified by like numerals with a primed (′) suffix and new components are identified by new numerals.

In this FIGURE, the fastener means 150 includes a cylinder member 152 having a piston therein such that a piston rod 154 extends therefrom. A nut member 156 is secured to a free end of the piston rod 154 such that it is positioned generally adjacent a flange 158 which extends radially outwardly from a cooling fluid trough 90′ and a second cooling fluid channel 78′. A second flange member 160 extends radially outwardly from a base support member 10′. The cylinder 152 is pivotally attached, as by pivot means 162, to the second flange 160. A cylinder stop 164 may extend in a spaced relation around the cylinder 160 to prevent the pivoting of the cylinder past a predetermined point.

In order to allow the cylinder to pivot, the piston rod 154 is raised, thereby spacing the nut 156 away from the first flange 158. Since a slot, not visible in FIG. 4, is provided in the first flange 158, once the nut 156 is spaced away from the flange 158, the fastener 150 is allowed to pivot away from the first flange. The cylinder 150 may be a dual acting cylinder which has a pressurized fluid conduit leading into each end thereof, as is disclosed although other types of cylinders can also be used. The use of this type of fastening means is advantageous where a fast and relatively effortless detachment of the cover means B′ from the base means A′ is desired.

The method of utilizing the annealing furnace or heat treating apparatus of the present invention is illustrated in FIG. 5. An annealing furnace having a base, a base fan secured thereto, a cover member supported on the base, and a heating hood enclosing the cover member is provided. At least one work item is positioned on the base such that it is enclosed by the cover member. Thereupon, the at least one work item is heated by the heating hood for a length of time. Preferably, the temperature in the heating space defined between the furnace or heating hood and the cover member is raised to a temperature of approximately 1550° F. (843° C.) during the heating cycle. As the heat of the furnace is slowly transmitted into the working space, the working space temperature will increase as is evident from the gas stream thermocouple temperature graph. However, the entire working space will not reach the same temperature as at the gas stream thermocouple, as is evident from the cold spot thermocouple graph. At the end of approximately 24 hours of heating, the cold spot thermocouple temperature will reach approximately 1280° F. (693° C.). At this point, the temperature at the cold spot thermocouple can be made to meet the temperature of the gas stream thermocouple and the heating cycle comes to an end. The transfer of heat from the furnace or heating hood into the work space, and hence to the work items D is, primarily through radiation. However, since a gas atmosphere is circulated within the inner cover, convection is also used to produce a more rapid and uniform transfer of heat.

Once the heating cycle is finished, the heating hood C is removed and is replaced with the cooling hood E. At this time, the cooling fans 138 of the cooling hood are activated and the base fan continues to circulate air within the cover member. In this way, through a process of both convection and radiation, heat is removed from the work member. At the beginning of the cooling cycle, a temperature of approximately 1280° F. (693° C.) is present within the work space. This temperature decreases steadily until a temperature of about 720° F. (382° C.), as measured by the cold spot thermocouple, is achieved within the work space.

At this point, the base fan is switched off, but the cooling hood fans continue to operate. In this way, the work space temperature, as measured by the cold spot thermocouple, decreases relatively rapidly from 720° F. to 550° F. (382° C. to 288° C.), in approximately one half hour. At this point, the base fan is again switched on and the cooling hood fans are switched off. After the cooling hood fans are deactivated, the cooling fluid spray is turned on to cool the cover member B by conduction as well as by convection and radiation. In this way, the work items D are cooled off at a relatively fast rate. The complete cooling cycle takes approximately 23 hours. Therefore, the entire annealing cycle from the beginning of the heating cycle to the end of the cooling cycle takes approximately 47 hours. The cooling cycle ends when the temperature within the work space is approximately 200° F. to 300° F. (93° C. to 149° C.).

The present invention thus relates to a new and improved apparatus for heat treating a work item positioned in a work space and a method of heat treating. The apparatus can include a base, a cover member, a heating hood, a cooling hood, and a seal means positioned between the base and the cover member. A cooling means is provided for cooling the seal means. Also, a new and improved base and diffuser member are provided for the annealing furnace.

The invention has been described with particular reference to preferred and alternate embodiments. Obviously, modifications and alterations will occur to others upon the reading and understanding of this specification. It is intended to include all such modifications and alterations insofar as they come within the scope of the appended claims or the equivalents thereof.

What is claimed is:

1. An apparatus for heat treating a work item, comprising:

a cover member defining a vertically elongated work space for receiving at least one associated work item; and, a generally horizontally oriented base means for supporting said cover member, said base means comprising:

a support member for supporting said cover member, and a base member for supporting the at least one associated work item, said base member comprising a metallic outer shell which is designed to prevent weld cracks in said outer shell as it undergoes heating, said shell comprising an upper wall having an integral curved peripheral edge, a side wall, and a weld joint therebetween, wherein said upper wall meets said side wall in a substantially vertical plane.

2. The apparatus of claim 1 wherein said base member further comprises an insulation material disposed within said outer shell.

3. The apparatus of claim 2 wherein said base member further comprises a reinforcing means positioned within said outer shell for strengthening said outer shell.

4. The apparatus of claim 1 further comprising a diffuser member positioned atop said base means, said diffuser member having a planar main portion and a periphery which is outwardly curved so that it lies at an angle of approximately 120° to the plane of said diffuser main portion.

5. The apparatus of claim 1 further comprising:

a first sealing member positioned between said base means and cover member for sealing said work space; and, cooling means for cooling said first sealing member.

6. The apparatus of claim 1 wherein said base member metallic outer shell is toroidally shaped and wherein said upper wall has curved peripheral inner and outer edges, said side wall being a cylindrical outer side wall and said weld joint being an outer weld joint therebetween.

7. The apparatus of claim 6 wherein said outer shell further comprises:

a cylindrical inner side wall;

a second weld joint connecting said inner side wall with said upper wall curved peripheral inner edge; and, a bottom wall secured to said inner and outer side walls.

8. The apparatus of claim 1 wherein said base member is held on said support member and wherein said support member has a longer diameter than said base member and extends radially outwardly past said base member.

9. An apparatus for heat treating a work item, comprising:

a cover member defining a vertically elongated work space for receiving at least one associated work item; and, a generally horizontally oriented base member for supporting the at least one associated work item, said base member being covered by said cover member and including a substantially toroidally shaped metallic outer shell which comprises:

an upper wall having curved peripheral inner and outer edges, an inner cylindrical side wall, an inner weld joint between said upper wall inner edge and said inner cylindrical side wall, an outer cylindrical side wall, and an outer weld joint between said upper wall outer edge and said outer cylindrical side wall, wherein said inner and outer side walls meet said upper wall inner and outer curved peripheral edges in a substantially vertical plane to prevent weld cracks as said metallic outer shell undergoes heating.

10. The apparatus of claim 9 wherein said base member metallic outer shell further comprises a bottom wall to which said inner and outer side walls are secured.

11. The apparatus of claim 9 further comprising a support member for supporting said cover member and said base member.

12. The apparatus of claim 11 wherein said base member further comprises an insulation means held in said metallic outer shell for shielding said support member from heat.

13. The apparatus of claim 11 wherein said base member further comprises at least one reinforcing beam held in said metallic outer shell for strengthening said metallic outer shell.

14. The apparatus of claim 11 wherein said base member further comprises:

a first cooling fluid channel secured to said support member;

a second cooling fluid channel secured to said cover member; and, a cooling fluid trough extending adjacent said second cooling fluid channel.

15. The apparatus of claim 14 further comprising a first sealing member positioned between said first and second cooling fluid channels.

16. The apparatus of claim 11 further comprising:

a fan having a motor secured to said support member such that a fan shaft extends upwardly through a central bore of said toroidally shaped metallic outer shell; and, a seal member positioned between said fan motor and said support member.

17. The apparatus of claim 15 wherein at least one of said first and second channels is an enclosed channel which is suitably configured so as to house said first sealing member.

18. The apparatus of claim 15 wherein said cooling fluid trough includes an inlet means and an outlet means.

19. The apparatus of claim 17 further comprising fastener means for fastening said cover means to said base means to draw said pair of channels toward each other.

20. The apparatus of claim 19 wherein said fastener means comprises a threaded stem and a nut.

21. The apparatus of claim 19 wherein said fastener means comprises a piston and cylinder assembly.

22. An apparatus for heat treating a work item, comprising:

a cover member defining a work space;

a base means for supporting said cover member, said base means including a base member on which at least one associated work item is supported, said base member comprising a metallic outer shell having an integral curved upper peripheral edge that is designed to prevent weld cracks in said metallic outer shell as it undergoes heating;

a heating hood for enclosing said cover member and defining a heating space therebetween;

a cooling hood for enclosing said cover member when said heating hood is removed and defining a cooling space between said cover member and said cooling hood including a means for spraying a cooling fluid on said cover member;

a first seal means for sealing between said base means and said cover member; and, a cooling means for cooling said first seal means said cooling means comprising:

a first enclosed cooling fluid channel secured to said base means;

a second enclosed cooling fluid channel secured to said cover member; and, a cooling fluid trough extending adjacent said second cooling fluid channel and being adapted to convey cooling fluid sprayed on said cover member away therefrom.

23. The apparatus of claim 22 further comprising:

a second seal means for sealing between said heating hood and said base; and, a means on said heating hood for confining said second seal means.

24. The apparatus of claim 23 wherein said second seal means is adapted to seal between a base wall of said heating hood and a top wall of said second cooling channel.

25. The apparatus of claim 22 wherein said base member is smaller in diameter than said cover member and is encircled thereby.

26. The apparatus of claim 22 wherein said first channel extends upwardly from said base means such that said first channel encircles said base member, said first channel including a groove in which said first seal means is positioned and wherein said second channel extends radially outwardly from said cover member so as to overlie said first channel.

27. The apparatus of claim 22 further comprising fastener means for fastening said cover member to said base means to draw said first and second channels toward each other.

28. The apparatus of claim 27 further comprising:

a first ear extending radially outwardly from said base means;

a second ear extending radially outwardly from said cover member so as to overlie said first ear, said two ears having aligned apertures therein; and, wherein said fastener means comprises a fastener member adapted to extend into said aligned apertures.

29. The apparatus of claim 23 wherein said first channel is U-shaped in cross section so as to accommodate said first seal means therein.

30. The apparatus of claim 29 wherein said second channel is L-shaped in cross section such that a first planar wall of said second channel overlies said first seal means and a second, spaced planar wall of said second channel lies beneath said second seal means.

31. The apparatus of claim 22 wherein said cooling hood comprises:

a hood body;

a first opening provided in said hood body to allow the atmosphere to circulate through said cooling hood;

a second opening in said hood body, said second opening being spaced from said first opening; and, a fan secured to said hood over said second opening and adapted to circulate air through said hood.

32. The apparatus of claim 31 wherein said cooling hood further comprises a cooling fluid pipe secured to said cooling hood; and, a cooling fluid nozzle positioned at an end of said cooling fluid pipe, said nozzle being adapted to spray cooling fluid on said cover member.

33. The apparatus of claim 32 wherein said cooling means trough collects said cooling fluid running down said cover member, and wherein said trough further comprises a drain pipe outlet for emptying said trough from the cooling fluid.

34. The apparatus of claim 33 wherein said cooling hood further comprises an annular inwardly extending skirt which directs cooling fluid into said trough.

35. The apparatus of claim 27 wherein said fastener means comprises a piston and cylinder assembly.

36. The apparatus of claim 35 further comprising a first ear extending outwardly from said cover member, a second ear extending outwardly from said base member, and wherein said piston and cylinder assembly comprises a cylinder body secured to said second ear and a piston rod on which is threaded a fastener that can selectively cooperate with said first ear.

* * * * *